US007086914B1

(12) United States Patent
Beamer et al.

(10) Patent No.: US 7,086,914 B1
(45) Date of Patent: Aug. 8, 2006

(54) MODULAR BRACKET SYSTEM FOR ENGINE MOUNTED TROLLING MOTORS AND THE LIKE

(75) Inventors: Gregory Paul Beamer, Mankato, MN (US); Wesley Calvin Marcus, St. Peter, MN (US); Jeffrey L. Crull, McFarland, WI (US); John A. Miller, Sun Prairie, WI (US)

(73) Assignee: Johnson Outdoors, Inc., Racine, WI (US)

( * ) Notice: Subject to any disclaimer, the term of this patent is extended or adjusted under 35 U.S.C. 154(b) by 0 days.

(21) Appl. No.: 11/139,053

(22) Filed: May 27, 2005

(51) Int. Cl.
*B63H 5/10* (2006.01)

(52) U.S. Cl. ..... 440/82; 440/6; 440/53

(58) Field of Classification Search ..... 440/6, 440/82, 3, 53, 84, 113
See application file for complete search history.

(56) References Cited

U.S. PATENT DOCUMENTS

D121,623 S * 7/1940 Casey ..... D12/317
3,139,853 A * 7/1964 McCarthy et al. ..... 440/66
3,596,625 A * 8/1971 Guenther ..... 440/6
4,200,055 A * 4/1980 Siegel ..... 400/5

* cited by examiner

*Primary Examiner*—Jesus D. Sotelo
(74) *Attorney, Agent, or Firm*—Kinney & Lange, P.A.

(57) ABSTRACT

A modular engine mount (EM) trolling motor/lower unit mounting bracket is provided. The bracket includes a lower mounting EM bracket that is secured to the cavitation plate of a vessel's outboard or I/O. This lower bracket includes a support carriage that supports the trolling motor. It is secured on the bracket by a cap. To accommodate dual trolling motors, a dual bracket is mounted on the lower bracket. This dual bracket includes a central yoke and two lateral support carriages. Caps are then used to secure each of the trolling motors/lower units on the lateral support carriages. In this configuration, the mounting yoke includes a closure structure that mates with the lower bracket to close the trough provided therein. In a tri-motor configuration, this closure structure is not included, and the trolling motor is secured in place on the lower bracket by the central mounting yoke.

21 Claims, 22 Drawing Sheets

MODULAR BRACKET SYSTEM FOR ENGINE MOUNTED TROLLING MOTORS AND THE LIKE

FIELD OF THE INVENTION

The present invention relates generally to trolling motor mounting systems, and more particularly to trolling motor mounting systems for mounting trolling motors and the like to a boat's outboard or inboard/outboard (I/O) engine.

BACKGROUND OF THE INVENTION

Electric trolling motors provide anglers with a quiet, smoke-free method of controlling their boat while fishing. They are typically used once an angler has reached a desired fishing location and the main engine is turned off. The size and configuration of the boat in addition to the conditions during which the angler will be fishing are the main factors in determining the thrust that will be needed to maintain proper control of the boat. The thrust provided by the trolling motor, and to a lesser extent the type of fishing preferred by the angler, will typically dictate how and where the trolling motor is mounted on the boat.

Many anglers, particularly those with smaller boats, often mount their trolling motor from the bow or transom of the boat. Transom mounting of the trolling motor is often used for anglers who use electric power exclusively and for traditional walleye anglers who like to backtroll. However, since the bow of a boat is pointed, a bow mount for a trolling motor provides a distinct advantage to control the boat in wind and waves. In either of these positions, however, the shaft length from the mount to the lower unit will limit, to some degree, the size of motor that can be used. In other words, for a bow mount trolling motor the length of the shaft for the mount to the lower unit will traverse the distance from the top of the bow to the water line plus, typically, 18 inches. With a large thrust motor, the amount of torque that is generated over this distance can be significant.

For larger boats that need higher thrust trolling motors, or for those fisherman who fish in adverse conditions and therefore require higher thrust, anglers often opt for an engine mounted trolling motor. Such engine mounted electric trolling motors typically utilize a formed or stamped metal bracket to permanently mount onto an I/O or outboard motor. One such product manufactured by the assignee of the instant application is illustrated in FIG. 25. The typical mounting location for such a bracket is directly on top of the main engine's cavitation plate. In such a location there is no drag or loss of performance while the boat is utilizing the main engine while the boat is on plane. That is, when a boat is accelerated with its main engine, the boat rises, lifting the engine mounted trolling motor out of the water. This eliminates any drag that otherwise would occur. Once the boat is stopped, it sinks back into the water, submerging the engine mounted trolling motor once again. While the trolling motor is being utilized, direction is controlled directly from the helm.

While such engine mounted trolling motors provide a distinct advantage for larger vessels and for anglers fishing in adverse conditions, e.g. high winds or waves, their application has been somewhat limited, primarily to fresh water applications. This is because many salt water vessels are much larger, requiring more thrust than is available from the current technology of trolling motors. Further, the permanent mounting brackets for these engine mounted trolling motors accommodate only a single size trolling motor. If a different size trolling motor is desired, the entire assembly, including the mounting bracket, must be removed and replaced. Therefore such trolling motors are not adaptable to changing conditions, loads, etc. that dictate the thrust requirements from such a trolling motor.

There exists, therefore, a need in the art for an engine mounted trolling motor bracket that can accommodate different sized trolling motors, different lower units, and that may allow for the inclusion of additional trolling motors or lower units when the thrust requirements of the vessel, or those dictated by the fishing conditions, so require.

BRIEF SUMMARY OF THE INVENTION

In view of the above, it is an objective of the present invention to provide a new and improved mounting bracket for an engine mounted trolling motor. More particularly, it is an objective of the present invention to provide a new and improved mounting bracket for an engine mounted trolling motor that can accommodate different sized trolling motors and/or different sized lower units. It is a further objective of the present invention to provide a new and improved bracket for an engine mounted trolling motor that may also accommodate the inclusion of multiple trolling motors or lower units to increase the thrust available to control the vessel. It is a further objective to provide such a modular mounting bracket that may still be permanently mounted to the cavitation plate of the main I/O or outboard engine of the vessel.

In one embodiment of the present invention, the modular engine mounted bracket is made of composite materials. Preferably the bracket includes a lower mounting engine mounted (EM) bracket that may be permanently affixed to the cavitation plate of the main outboard or inboard/outboard (I/O) engine of a water craft. The modular bracket also includes a single EM top cap that may be used to secure the trolling motor or lower unit in position on the lower mounting EM bracket. Removable front and rear adaptor rings are also provided to accommodate different sized lower units and/or trolling motors with the modular bracket of the present invention.

To allow for substantially increased thrust availability, the modular bracket of the present invention also includes a dual mounting bracket that mates with the lower mounting EM bracket to accommodate multiple trolling motors or lower units. These multiple trolling motors or lower units would be secured to the dual mounting bracket by using the EM top cap in similar fashion as is used to secure a single trolling motor or lower unit on the lower mounting EM bracket itself. In a further embodiment, three trolling motors may be accommodated by utilizing a tri-mounting bracket secured on the lower mounting EM bracket and utilizing the EM top caps in similar fashion.

Through the modularity of the design of the mounting bracket of the present invention, an angler now may utilize different sized trolling motors to supply the different thrust requirements as may be dictated by the load in the fishing vessel and/or the conditions under which the vessel will be subjected during the fishing excursion. Incremental increases in thrust capability, as well as doubling and tripling the thrust capability are accommodated through this modular design. This modular design also allows the expensive trolling motor to be removed and safely stowed away without removing the mounting bracket from the cavitation plate itself. Additionally, from a manufacturing standpoint, the modularity allows an OEM to supply a broad range of product offerings without having to stock a large number of different brackets.

In alternate embodiments the modular mounting bracket of the present invention may be made from various materials utilizing various processes such as machining or welding or other forms of fabrication. Depending on the conditions under which the bracket will be used, Ferrous or non-Ferrous metals as well as other types of plastic resins, composites or epoxies may be used to fabricate the bracket of the present invention.

The modularity of the bracket of the present invention enables a manufacturer to offer a large number of products with different thrust potentials that fit various applications, allowing for operation in both fresh water and salt water applications, while limiting the investment required to accomplish this. To date, there have been no reasonable solutions that provide an economic means of facilitating multiple trolling motor configurations through the use of a single modular bracket system.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

To provide the adaptability of different thrust trolling motors in an engine mount (EM) configuration, the modular bracket of the present invention utilizes a common mounting bracket with interchangeable elements. As such, the single modular mounting bracket of the present invention may accommodate different sized trolling motors in each of a single, double, or even triple trolling motor configuration. Additionally, in the double and triple trolling motor configuration, there is no requirement that the trolling motors be of the same size.

Figure 1:
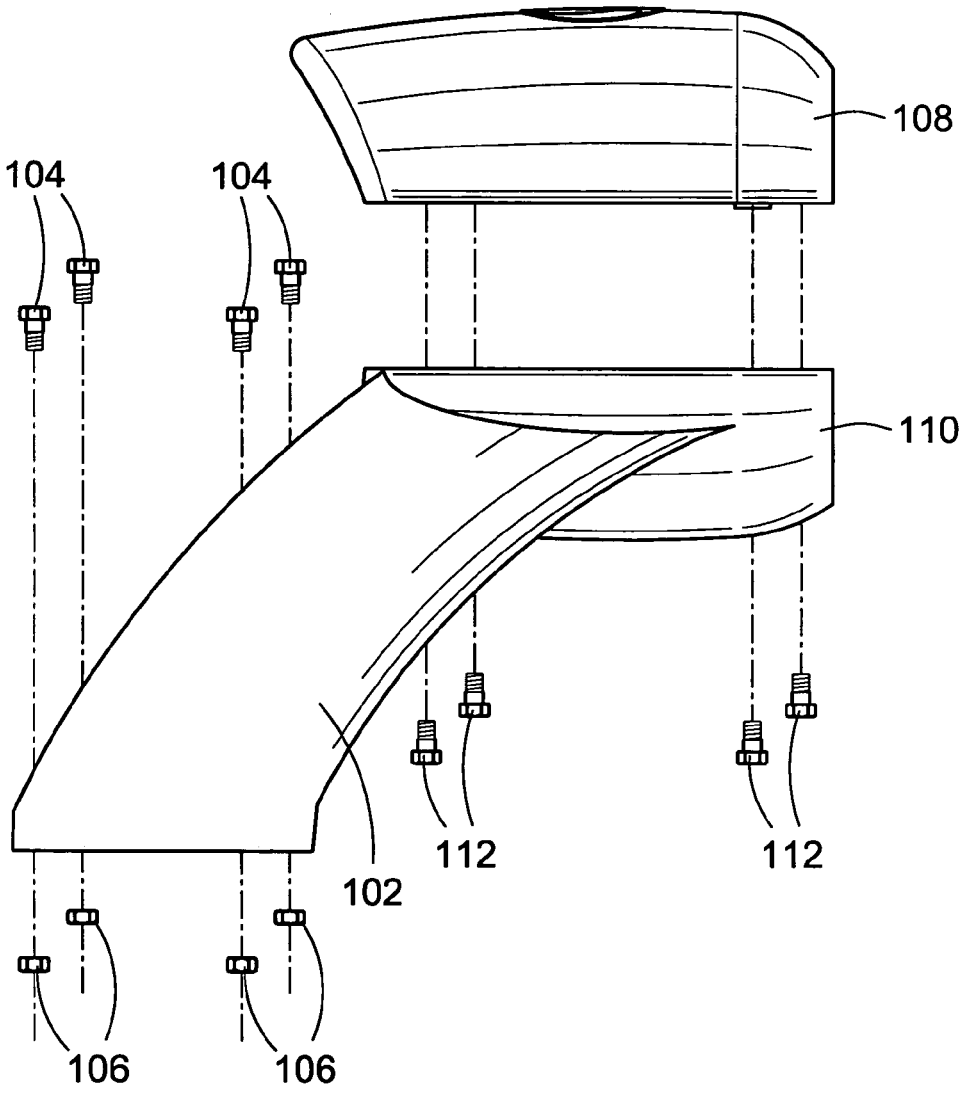
FIG. 1 is an exploded side view illustration of one embodiment of the modular engine mounting bracket of the present invention configured for use with a single trolling motor or lower unit.

Turning now to the drawings, wherein like numbers refer to like elements, there is illustrated in FIG. 1, one embodiment of a modular EM trolling motor bracket configured for single trolling motor applications. The modular bracket of the present invention 100 includes a lower mounting EM bracket 102 that may be secured to the cavitation plate of the vessel's outboard or I/O engine in a conventional fashion utilizing fasteners, e.g. bolts 104 and nuts 106. In the single trolling motor application, an EM top cap 108 is secured to the central support carriage portion 110 of the lower mounting EM bracket 102 via fasteners, e.g. bolts 112.

Preferably, the modular bracket 100 of the present invention is made from composite materials that reduce the weight and cost of the bracket 100 while increasing its ruggedness to allow for application in both salt water as well as fresh water applications. In a highly preferred embodiment, the modular bracket 100 of the present invention is made from a polyarylamide resin, e.g. IXEF 1022 manufactured by Solvay S.A. However, alternate embodiments of the modular bracket 100 of the present invention are made by machining, welding, or other various forms of fabrication. Still further, alternate embodiments of the present invention are made from ferrous metals, non-ferrous metals, other types of plastic resins, composites or epoxies depending on the particular application for which this modular bracket 100 is designed.

Figure 2:
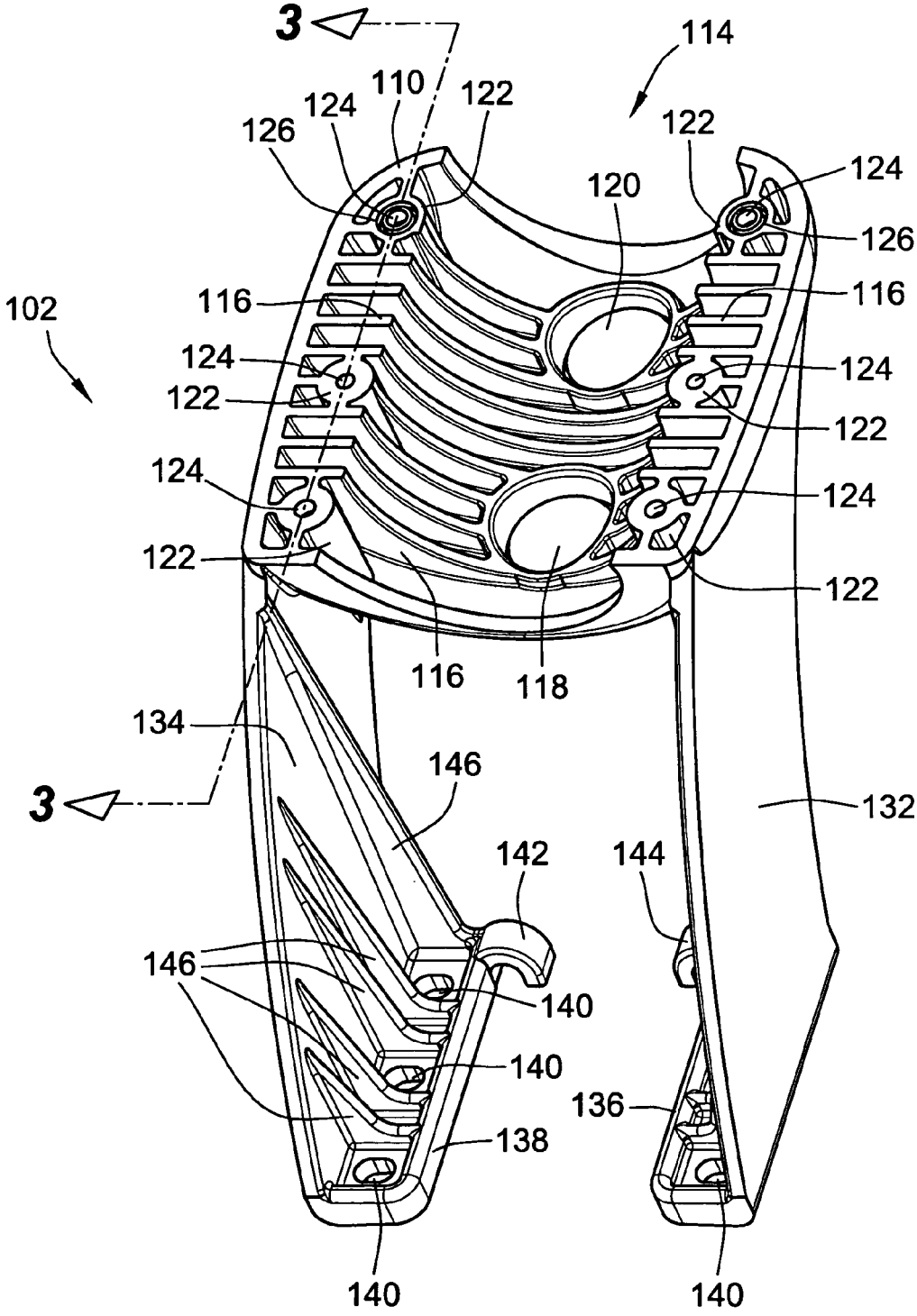
FIG. 2 is an isometric illustration of the lower mounting EM bracket of one embodiment of the present invention.

As illustrated in greater detail in FIG. 2, the lower mounting EM bracket 102 includes a central support carriage 110 that includes a mounting trough 114 defined along a longitudinal axes of the central support carriage. In the composite embodiment illustrated in FIG. 2, this central support carriage 110 includes a plurality of support ribs 116 that strengthen the overall structure of the support carriage 110 while minimizing the weight of the lower mounting EM bracket 102. This central support carriage 110 also includes therein molded knock-outs 118, 120. These knock-outs 118, 120 are positioned to accommodate the bung of the trolling motor to be secured in the mounting trough 114. Depending on the size and configuration of the trolling motor to be used, only one of the knock-outs 118, 120 need be removed to allow the control cables to the trolling motor to be passed therethrough. However, both knock-outs 118, 120 can be removed as desired to accommodate switching between different sized or configuration trolling motors as desired. In an alternate embodiment, these knock-outs are molded in the open condition.

The central support carriage 110 of the lower mounting EM bracket 102 also includes a plurality of fastener mounting structures 122 that define therethrough mounting holes 124 to receive fasteners 112 (see FIG. 1) to secure the EM top cap 108 thereon. To prevent the EM top cap 108 from being installed in the wrong orientation, the EM top cap 108 and the central support carriage 110 are keyed. In this embodiment mounting grooves 126 are provided on one set of the mounting structures 122. These mounting grooves 126 accommodate a mounting ridge 130 on the EM top cap 108 (see FIG. 6) as will be described more fully below. Through the use of this groove 126 and ridge 130, the EM top cap 108 may only be secured in the proper orientation on the lower mounting EM bracket 102.

The central support carriage 110 is held in proper orientation by a pair of forwardly downwardly depending mounting legs 132, 134. These mounting legs 132, 134 are formed or coupled to either side of the central supporting carriage 110 to provide a rigid support for securing the trolling motor in proper orientation above the cavitation plate. In this way, when the vessel is on plane during use of the main engine, the central support carriage 110 is positioned out of the water to eliminate any drag that would otherwise be present during such operation.

Each of the mounting legs 132, 134 terminates at a lower end thereof in a mounting land 136, 138. These mounting lands 136, 138 are secured on the top surface of the cavitation plate by fasteners 104 (see FIG. 1) that are accommodated through mounting holes 140. It should be noted that while the embodiment illustrated in FIG. 2 includes six (6) mounting holes 140, these are provided for convenience to allow retrofit for existing engine mount trolling motors for which holes may have already been drilled into the cavitation plate of the main outboard or I/O engine.

The mounting lands 136, 138 also include, in a preferred embodiment, at least one cable guide claw 142, 144. In such an embodiment the cable guide claws 142, 144 may be used to position the trolling motor/lower unit control/power cable when mounted on the vessel. In this embodiment, the cable is held between the cavitation plate on which the lower mounting EM bracket is secured and the cable guide claw 142, 144. The cable may then be routed back along the cavitation plate and up the outboard or I/O as is conventional.

Figure 3:
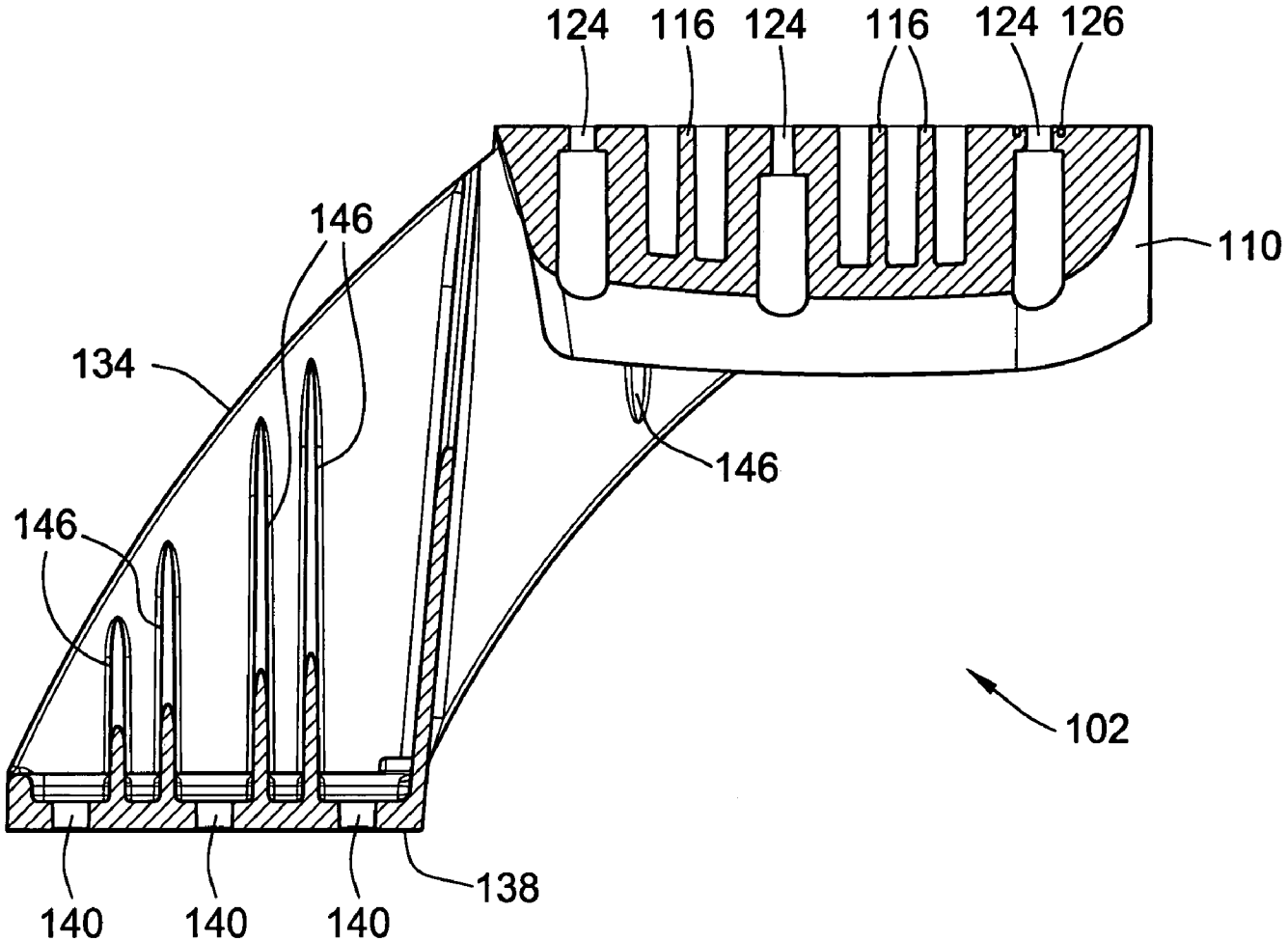
FIG. 3 is a sectional side-view illustration of the lower mounting EM bracket of FIG. 2.

In an embodiment of the present invention wherein the lower mounting EM bracket is made of composite material, each of the mounting legs 132, 134 includes a plurality of strengthening ribs 146. These ribs increase the strength and rigidity of the mounting legs while minimizing the weight of the overall bracket 102. Preferably, these strengthening ribs 146 extend vertically along the mounting legs 132, 134 and horizontally across mounting lands 136, 138. The support ribs 146 may also be seen in the cross-sectional side view illustration of FIG. 3.

Figure 4:
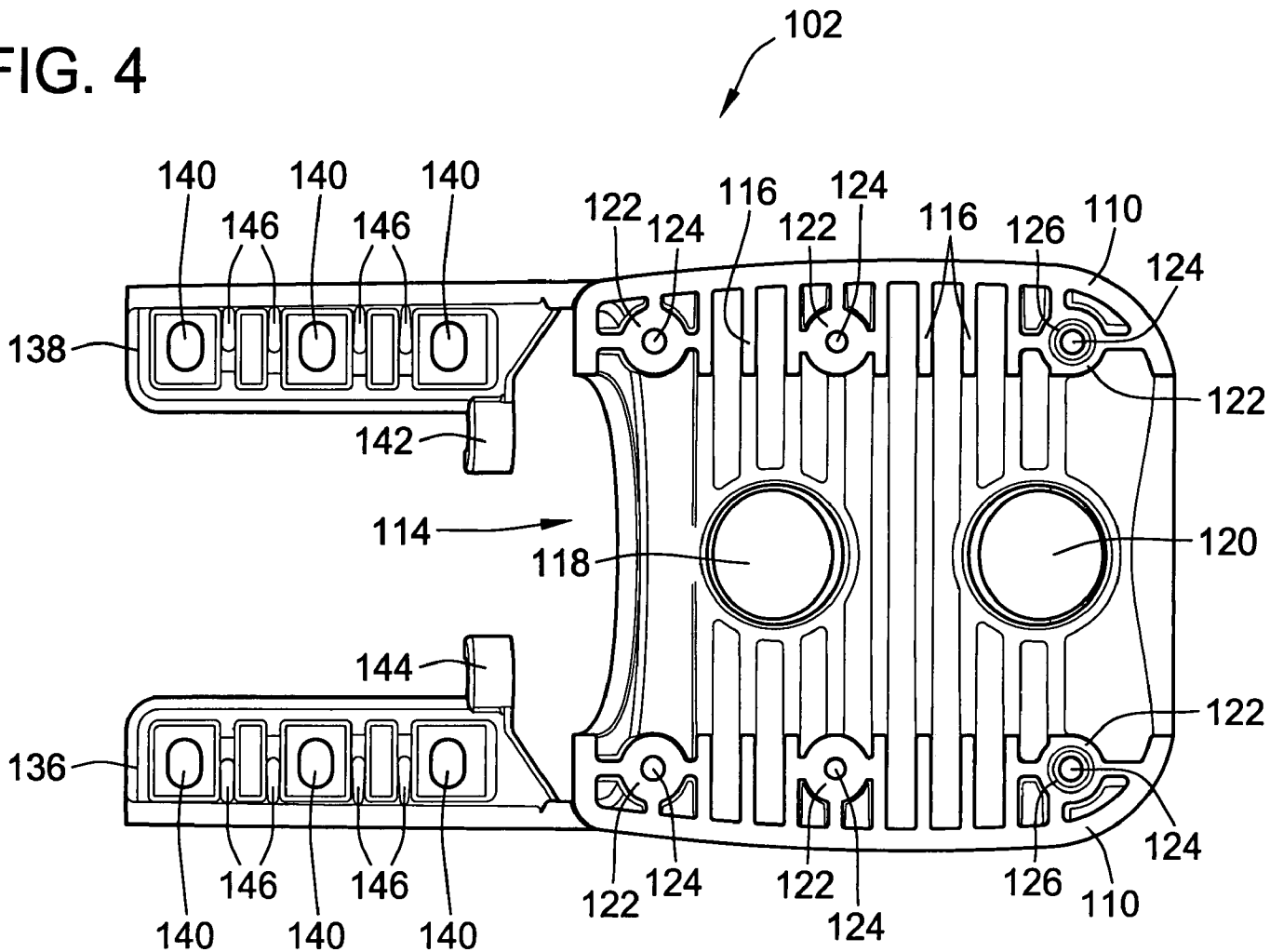
FIG. 4 is a top view illustration of the EM bracket of FIG. 2.

The top view illustration of the lower mounting EM bracket 102 of FIG. 4 illustrates the relative positioning of the central support carriage 110 and the mounting lands 136, 138. As oriented in FIG. 4, the mounting lands 136, 138 are mounted forward of the central support carriage 110 on the cavitation plate of the main outboard or I/O of the vessel. This orientation allows proper positioning of the trolling motor/lower unit on the central support structure relative to the main outboard engine or I/O. That is, in a typical embodiment, the trolling motor/lower unit includes a forward, cone-shaped portion that extends forward of the central support carriage 110. Without the relative orientation illustrated in the embodiment shown in FIG. 4, this leading portion of the trolling motor/lower unit would contact the outboard or I/O. This orientation also provides a more balanced weight distribution on the mounting structure 102 as at least a portion of the trolling motor/lower unit is positioned forward of the central support carriage 110.

Figure 5:
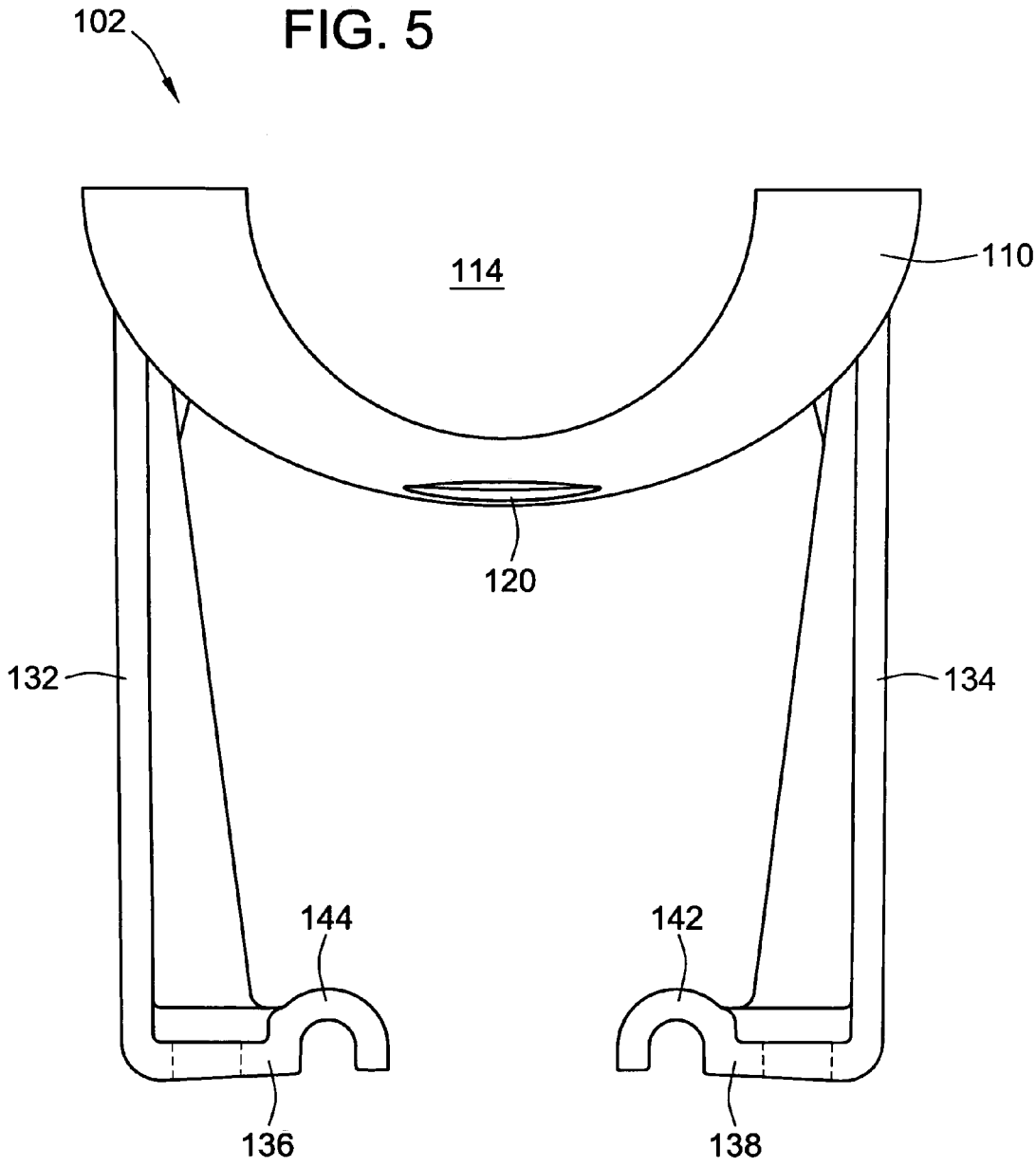
FIG. 5 is an end view illustration of the lower mounting EM bracket of FIG. 2.

The end view illustration of the lower mounting EM bracket 102 shown in FIG. 5 illustrates the mounting trough 114 provided by the central support carriage 110. As will be apparent to those skilled in the art, the end view illustration of FIG. 5 is shown with a prospective looking at the rearward end of the lower mounting EM bracket 102 as it would be mounted on the cavitation plate of the vessels outboard or I/O. This FIG. 5 also illustrates the removal of one of the knock-outs 120 to accommodate the bung of the trolling motor/lower unit to allow the control and/or power cables to pass through the central supporting carriage 110.

Figure 6:
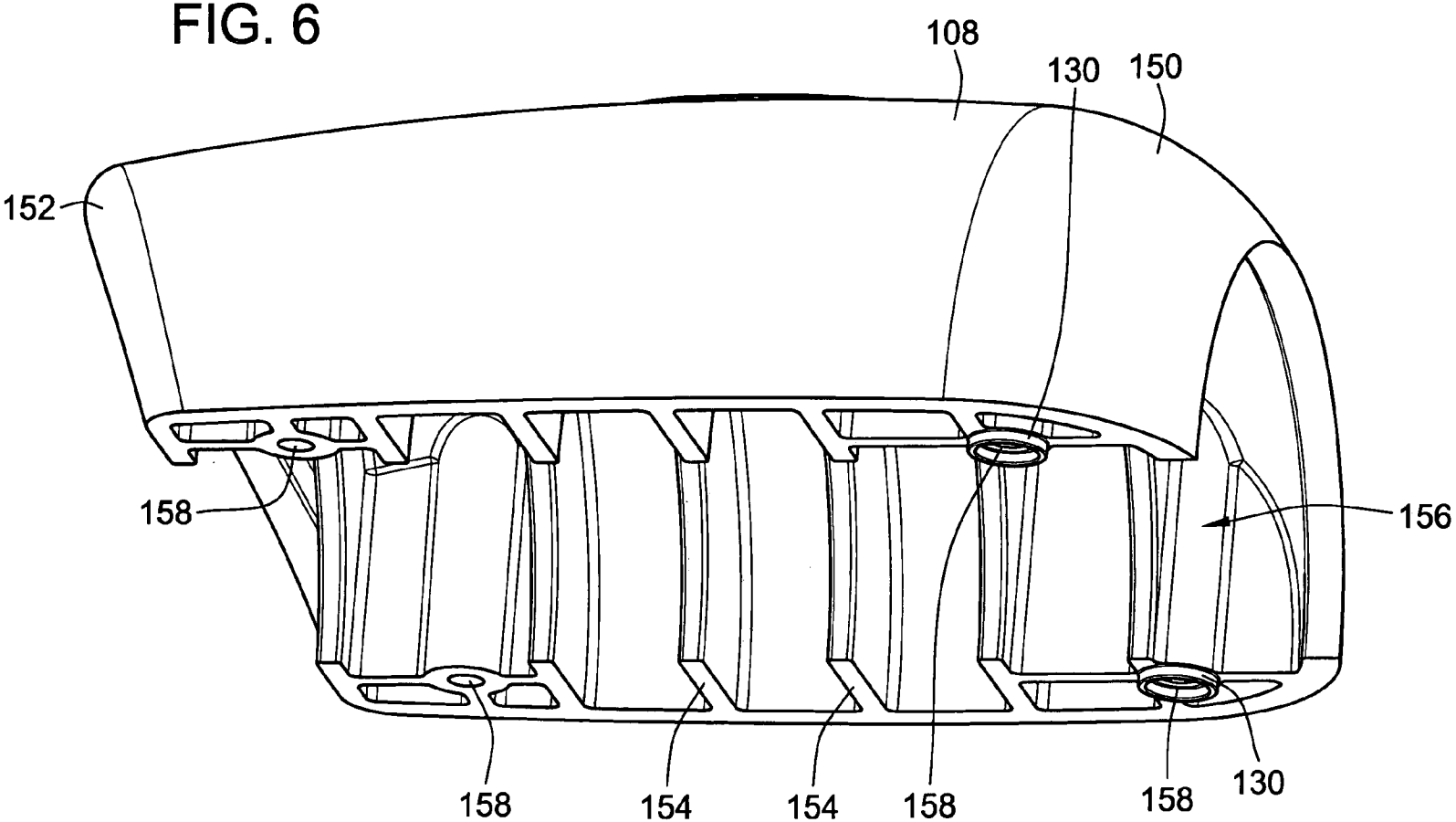
FIG. 6 is an isometric illustration of an embodiment of an EM top cap of the present invention.
Figure 7:
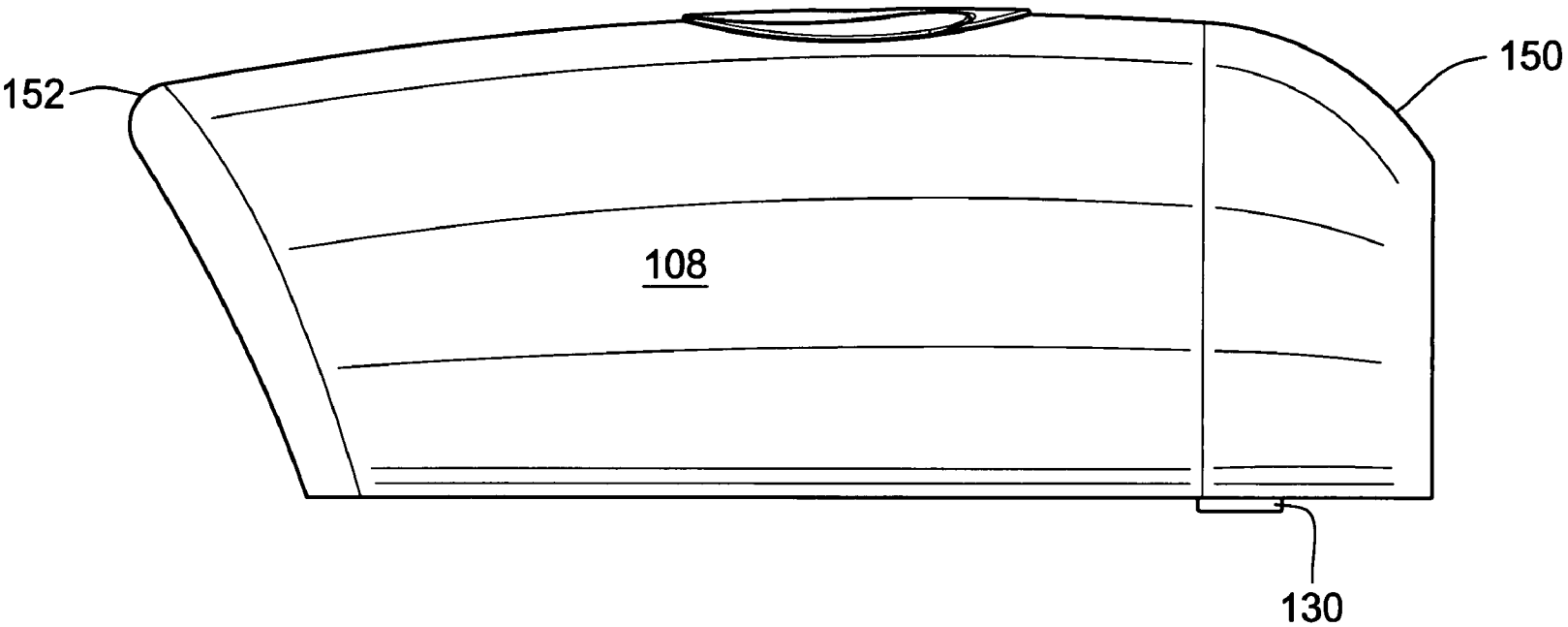
FIG. 7 is a side view illustration of the EM top cap of FIG. 6.

The EM top cap 108 is illustrated in isometric form in FIG. 6. This EM top cap 108 includes a radiused reward surface 150. The EM top cap 108 also includes a forward cowl portion 152. In a preferred embodiment, the EM top cap 108, like the lower mounting EM bracket 102, is made of a composite material. In such an embodiment, strengthening ribs 154 are provided on the interior surface to reduce the weight and increase the rigidity of the EM top cap 108. In this embodiment the ribs 154 form a top cap mounting trough 156 through the top cap 108 to accommodate the trolling motor/lower unit. As introduced above, the top cap 108 is keyed to the lower mounting EM bracket 102 so that it may only be seated thereon in one orientation. This prevents the EM top cap 108 from being mounted backwards on the lower mounting EM bracket 102. This keying is provided, in a preferred embodiment, by mounting ridges 130 that are accommodated in grooves 126 (see FIG. 2). The EM mounting cap 108 also includes a plurality of mounting bores 158 that align with the mounting holes 124 in the lower mounting EM bracket. Preferably, these mounting bores 158 are threaded.

Figure 8:
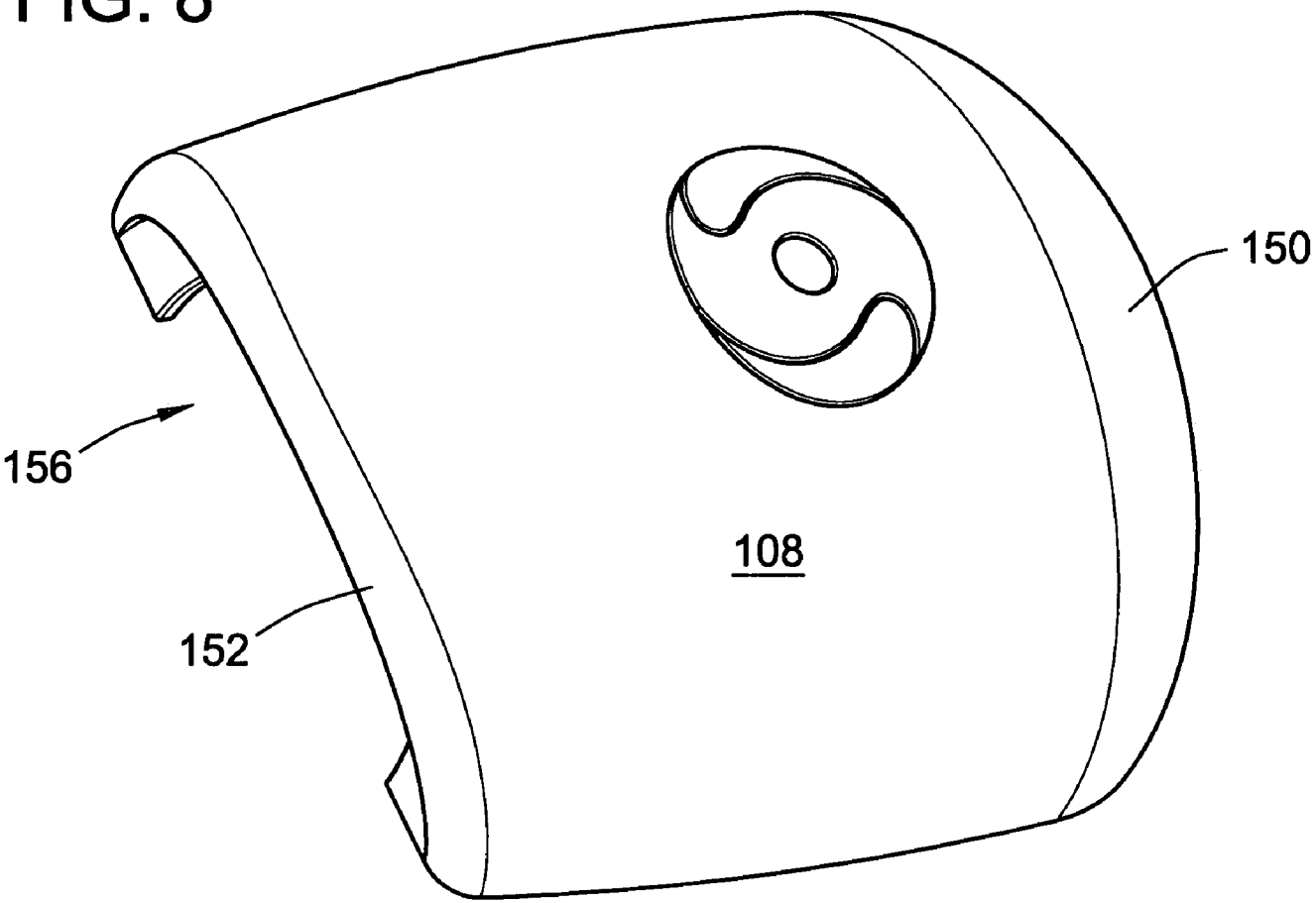
FIG. 8 is an isometric top view illustration of the EM top cap of FIG. 6.
Figure 9:
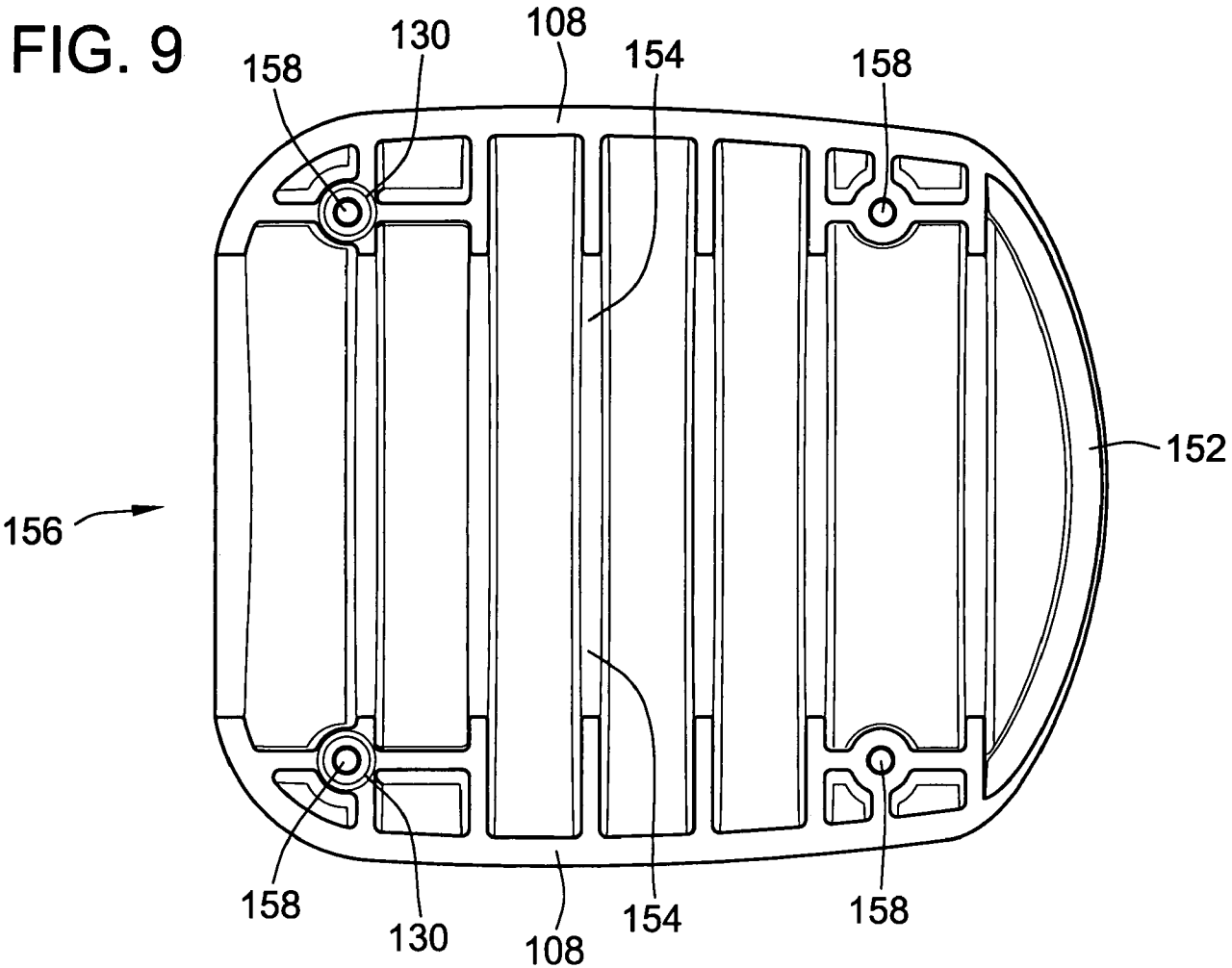
FIG. 9 is a bottom view illustration of the EM top cap of FIG. 6.
Figure 10:
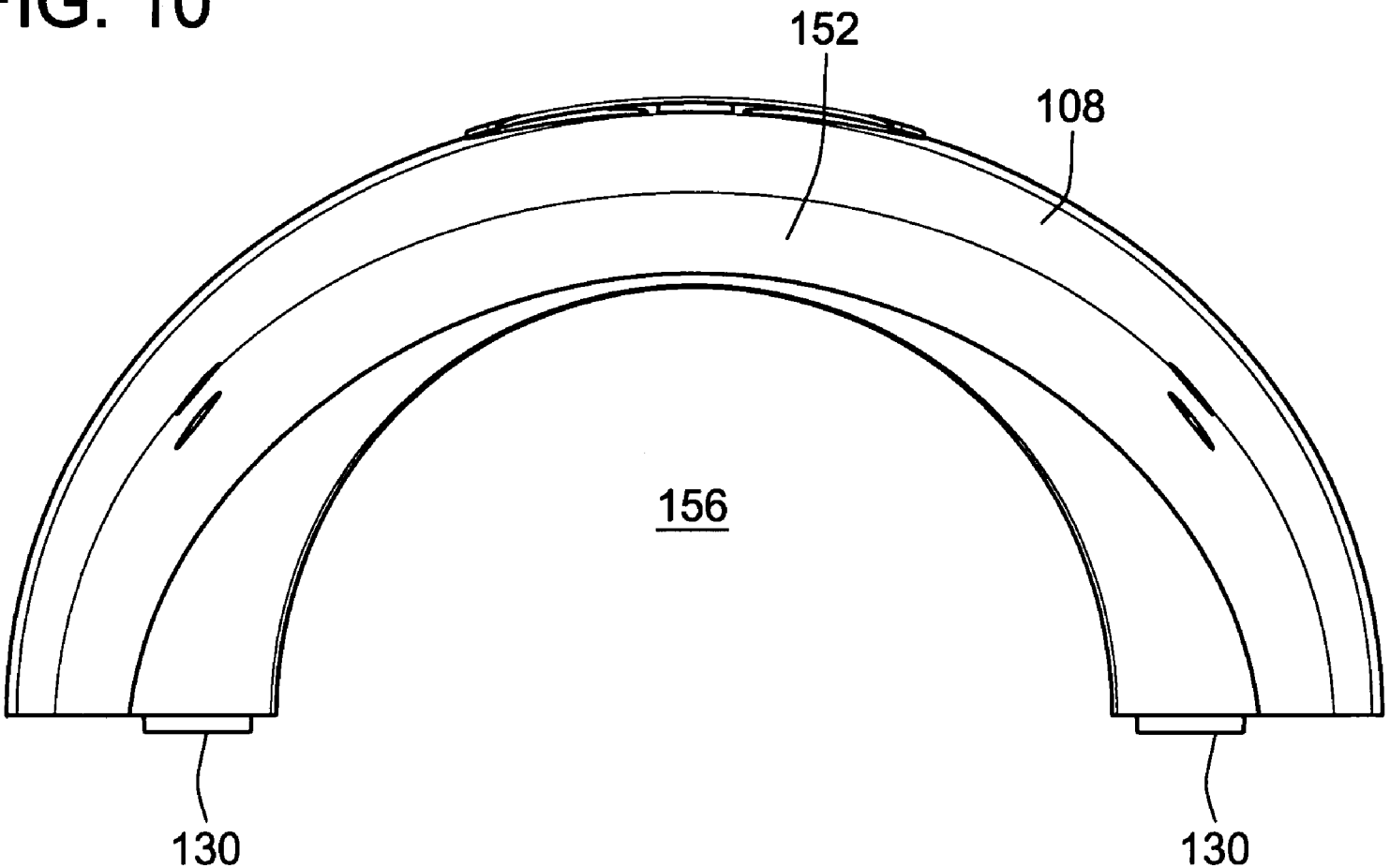
FIG. 10 is a end view illustration of the EM top cap of FIG. 6.

The side view illustration of the EM top cap 108 better illustrates the trailing radiused surface 150 and the cowl portion 152 provided by the EM top cap 108. As may be seen from the top isometric view of FIG. 8, the cowl portion 152 extends beyond the forward opening of the top cap mounting trough 156. This forward extension of the cowl portion 152 beyond the forward opening of the support trough 156 is also apparent from the bottom view illustration of the top cap 108 illustrated in FIG. 9. As may also be seen from this bottom view illustration of FIG. 9, the side profile of the top cap 108 also narrows from back to front to enhance the hydrodynamic configuration thereof. This tapered profile may also be seen from the end view of the top cap 108 illustrated in FIG. 10.

Figure 11:
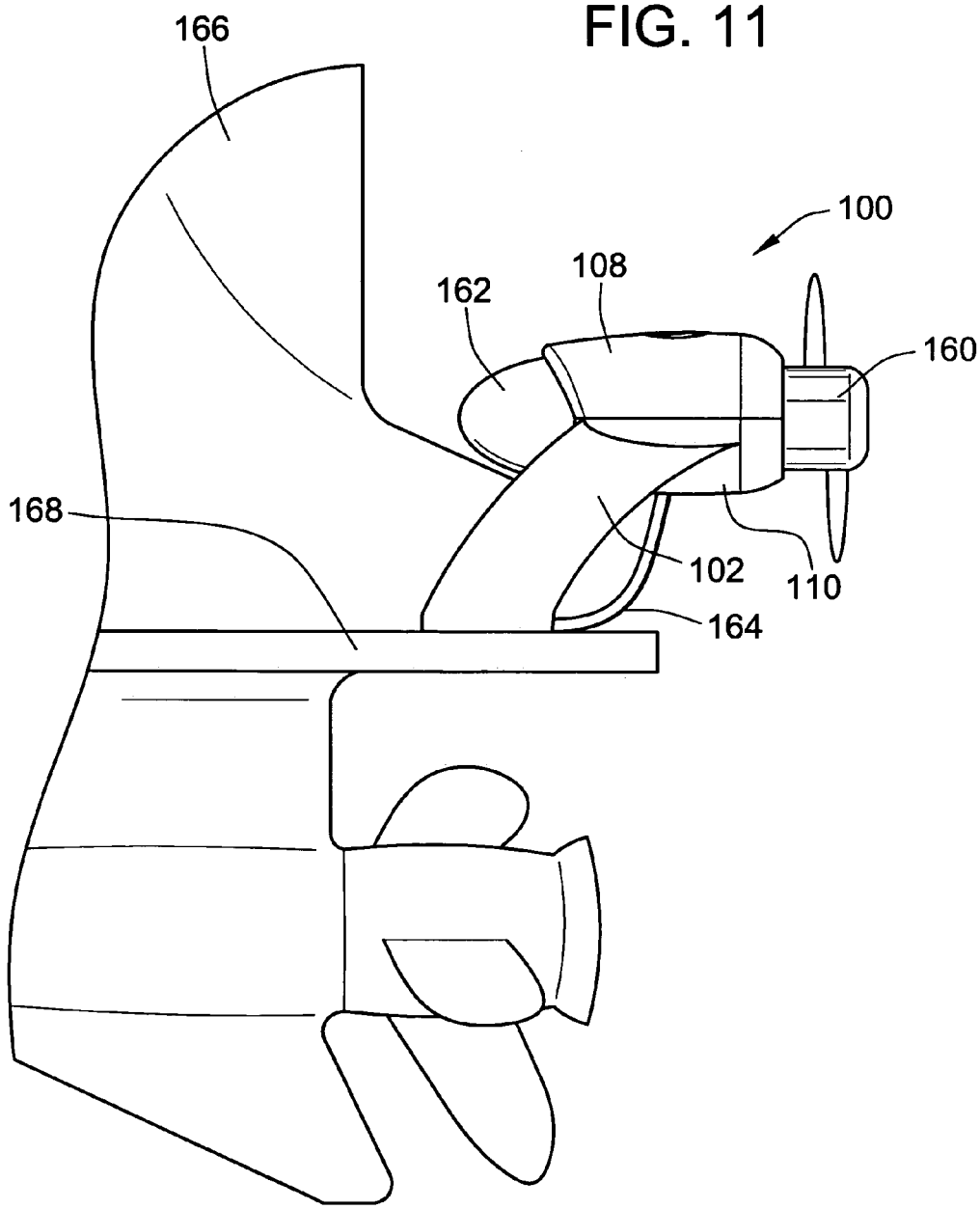
FIG. 11 is an assembled side view illustration of one embodiment of the modular EM mounting bracket of the present invention housing a single trolling motor.

In operation, the modular EM bracket 100 of the present invention secures the trolling motor 160 between the EM top cap 108 and the lower mounting EM bracket 110 as illustrated in FIG. 11. The assembly 100 is mounted to the cavitation plate 168 of the vessel's drive 166. As discussed above, the forward portion 162 of the trolling motor 160 extends forward of the central support carriage 110 and the EM top cap 108 to increase balance, and to provide better hydrodynamic performance. Also as discussed briefly above, the trolling motor's control and other cables 164 are accommodated through one of the knock-outs in the central support carriage 110, and may be held in place by the cable guide claws discussed above.

Figure 12:
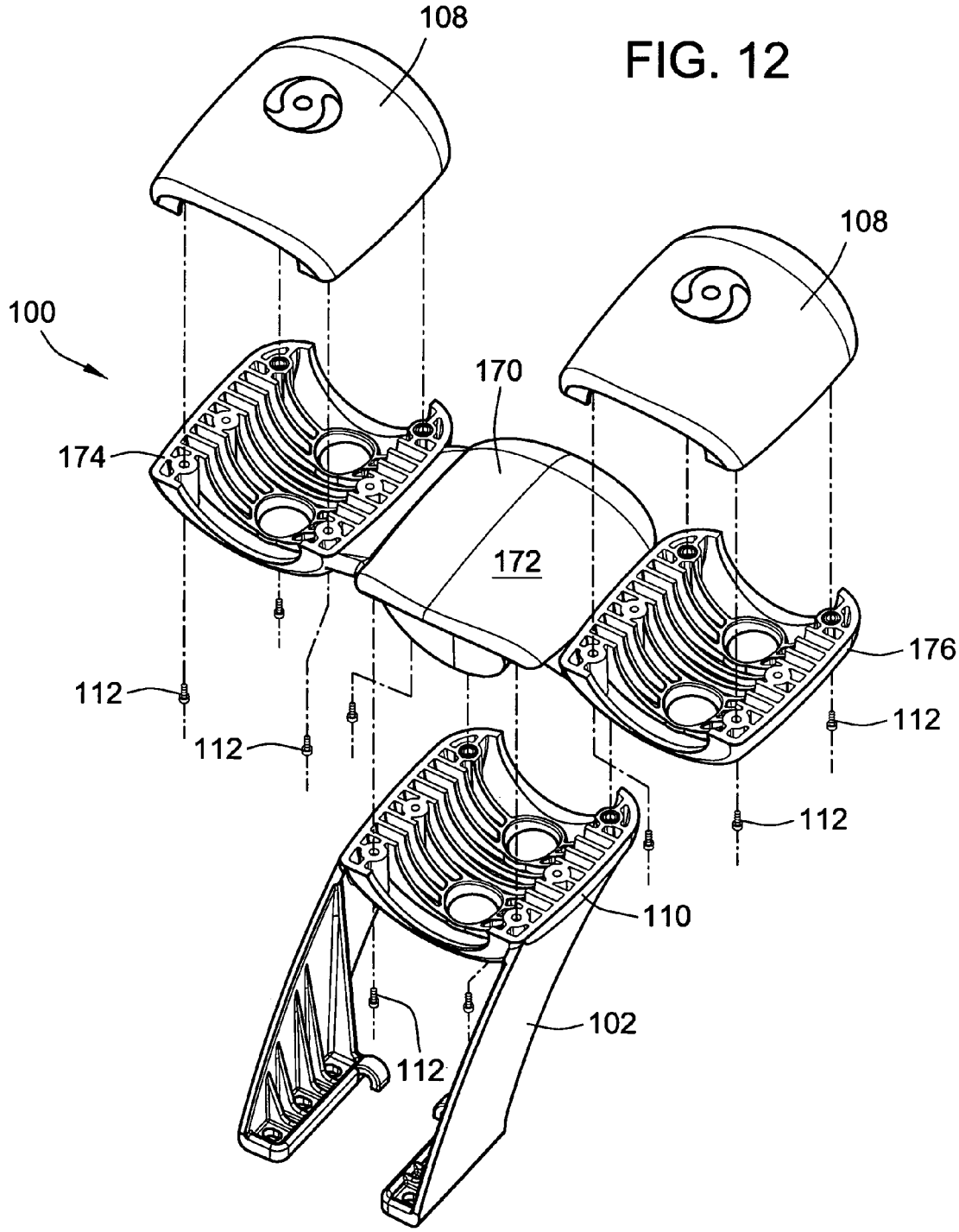
FIG. 12 is an exploded isometric illustration of an embodiment of the modular EM bracket of the present invention utilizing a dual mounting bracket for accommodating two trolling motors or lower units.

One of the advantages provided by the modular bracket of the present invention is its ability to accommodate different models and configurations of trolling motors to provide a wide product offering without having to stock a wide variety of brackets. While the preceding discussion illustrated the modular bracket 100 of the present invention's ability to accommodate a trolling motor/lower unit, this bracket 100 may also accommodate multiple trolling motors/lower units as illustrated in FIG. 12. As will be apparent to those skilled in the art, the lower mounting EM bracket 102 and the EM top caps 108 are the same as used in the single trolling motor/lower unit assemblage. To accommodate two trolling motors/lower units, a dual mounting bracket 170 is utilized with the lower mounting EM bracket 102 and the EM top caps 108. The dual mounting bracket 170 includes a central mounting yoke 172 with a pair of lateral support carriages 174, 176 positioned on either side of the support yoke 172. As will be discussed more fully below, these lateral support carriages 174, 176 are configured, in the preferred embodiment, identically with the central support carriage 110 of the lower mounting EM bracket 102. In this way, the dual trolling motors/lower units may be accommodated in each of the individual lateral support carriage 174, 176 in the same way as a single trolling motor/lower unit is accommodated in the central support carriage 110, using the EM top cap 108 to secure the trolling motor/lower unit therein.

Figure 13:
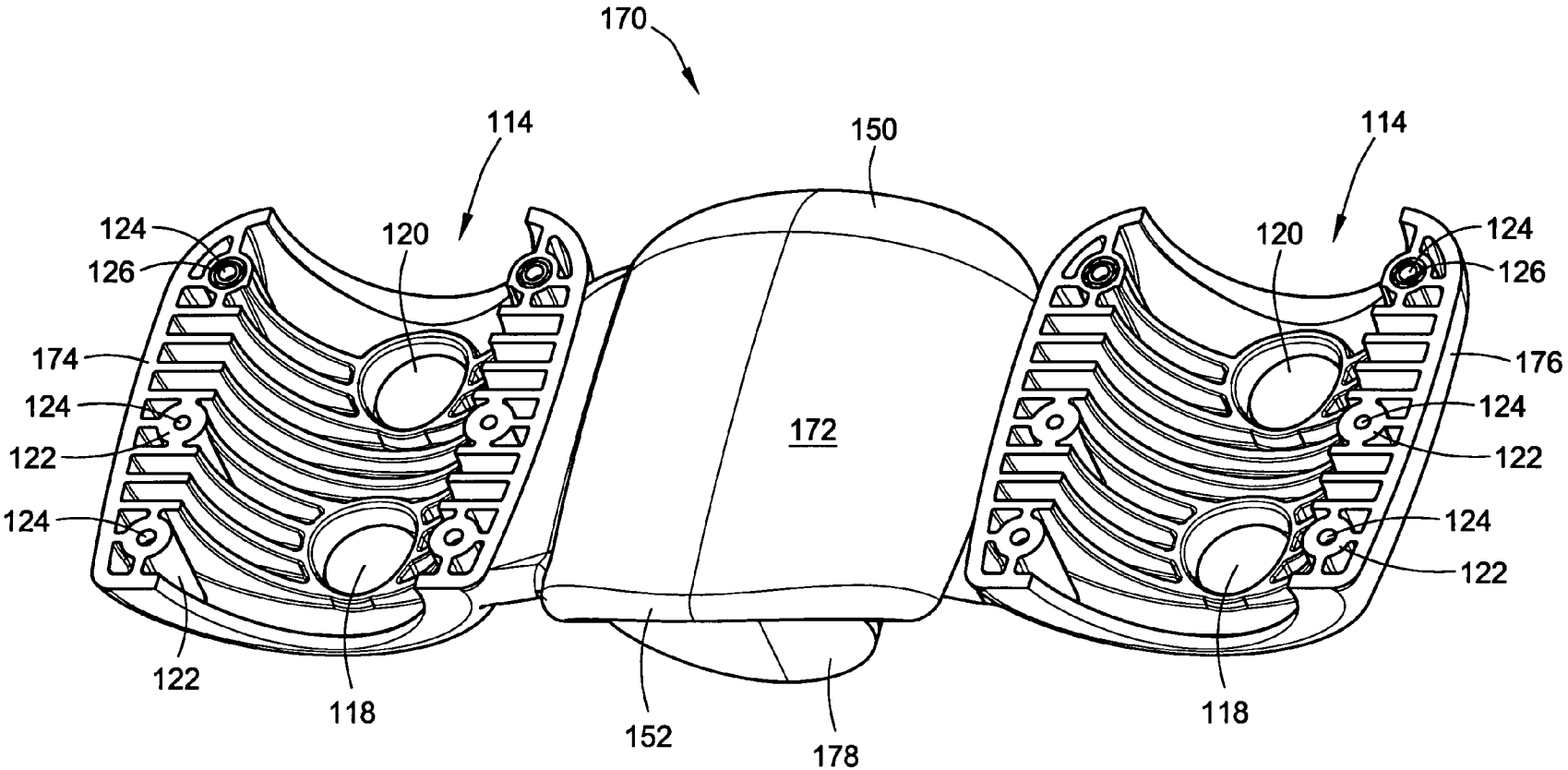
FIG. 13 is an isometric top view illustration of the dual mounting bracket illustrated in FIG. 12.

As shown in the isometric illustration of the dual mounting bracket 170 of FIG. 13, the central mounting yoke 172 includes a support carriage trough closure structure 178 that meets with and closes the mounting trough in the central support carriage 110 (see FIG. 12) of the lower mounting EM bracket 102. The central mounting yoke 172 is also configured similarly to the EM top cap 108 with its leading edge cowling 152 and contoured trailing edge 150. Each of the lateral support carriages 174, 176 positioned on either side of the central mounting yoke 172 are configured, in a preferred embodiment, identically to the central support carriage 110 as introduced briefly above. As such, these structures will not be described in further detail herein in the interest of brevity.

Figure 14:
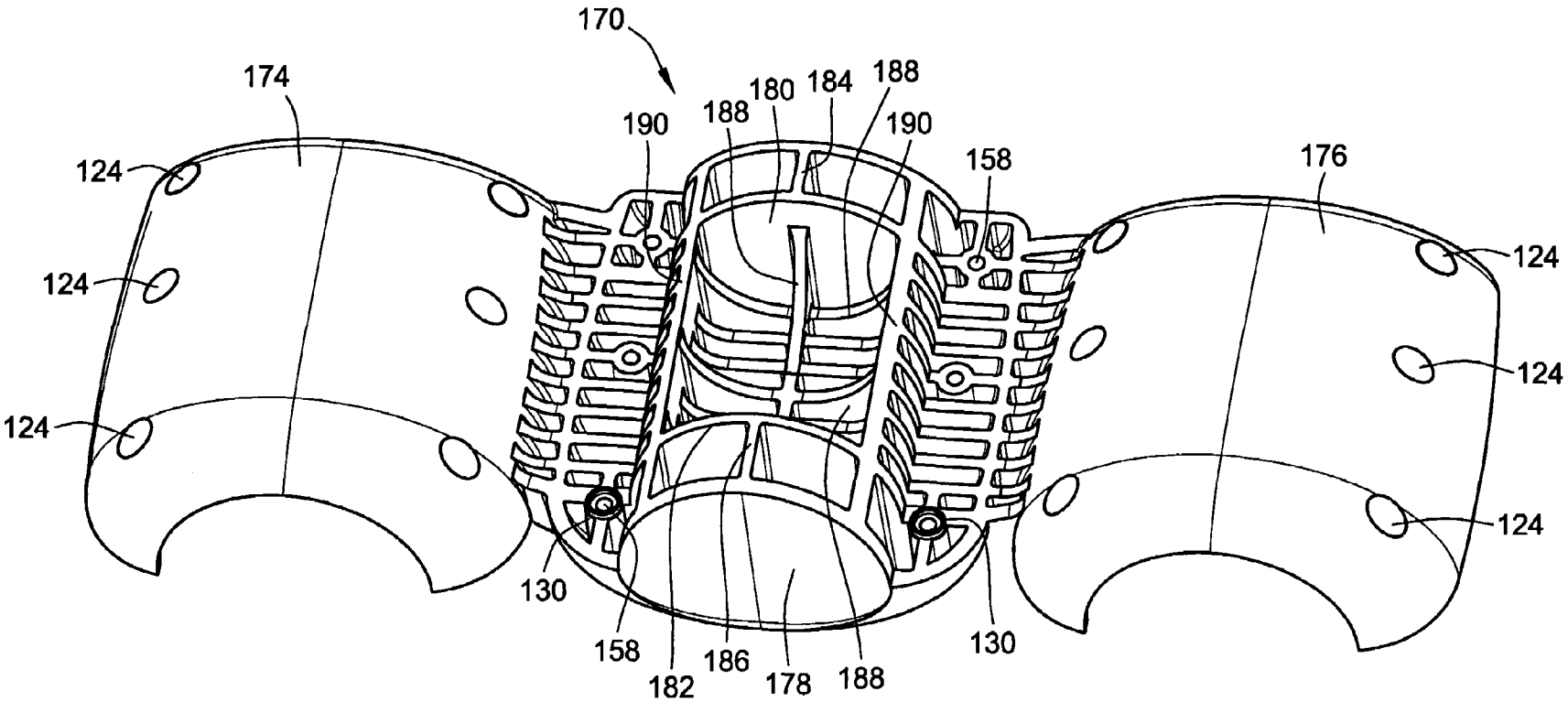
FIG. 14 is an isometric bottom view illustration of the dual mounting bracket of FIG. 13.

As illustrated in FIG. 14, the central carriage trough closure structure 178 is configured to meet with the mounting trough 114 of the central support carriage 110. This structure 178 takes the place of the trolling motor/lower unit that is typically mounted in the trough 114 in a single trolling motor/lower unit configuration.

In a preferred embodiment of the dual mounting bracket 170, the dual mounting bracket 170 is also made of a composite material. In this embodiment, the structure 178 provides double-walled end structures 180, 182 with supporting ribs 184, 186 to provide the required rigidity for the structures. Interior support ribs 188 as well as longitudinal support walls 190 complete the trough closure structure 178. The central mounting yoke 172 also includes the keying structures 130 to insure that the dual mounting bracket 170 is only mounted in one orientation on the lower mounting EM bracket 102.

Figure 15:
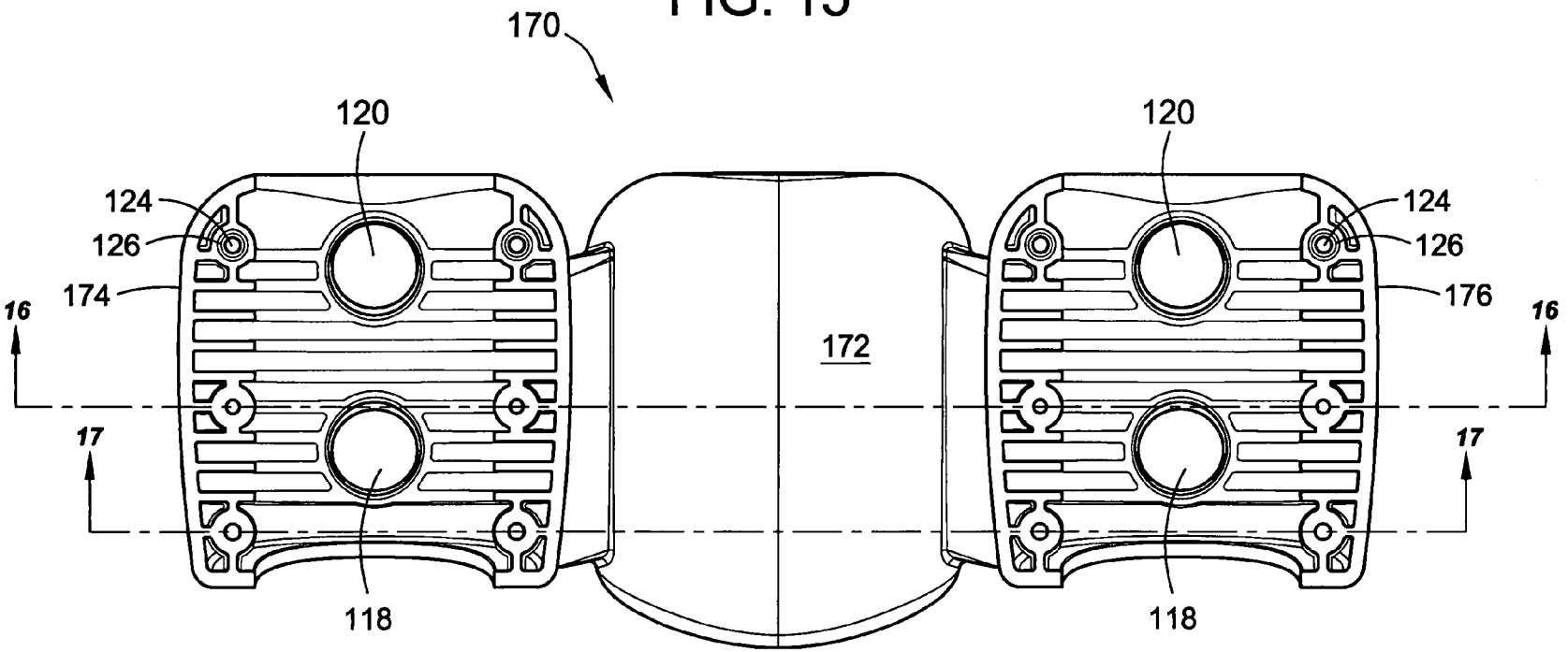
FIG. 15 is a top view illustration of the dual mounting bracket of FIG. 13.
Figure 16:
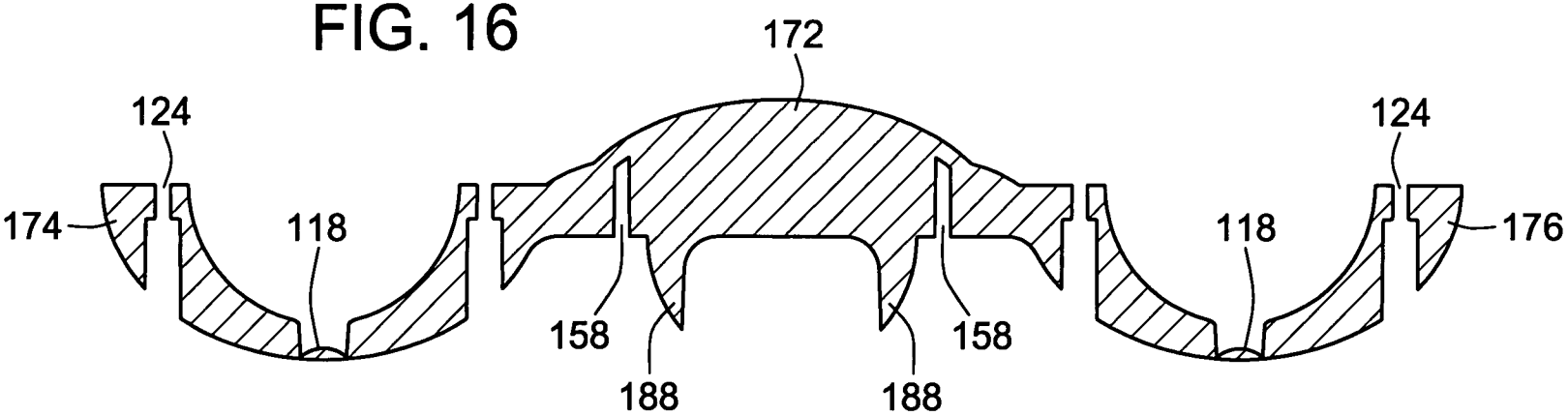
FIG. 16 is a section view illustration of the dual mounting bracket taken about section line 16—16 illustrated in FIG. 15.
Figure 17:
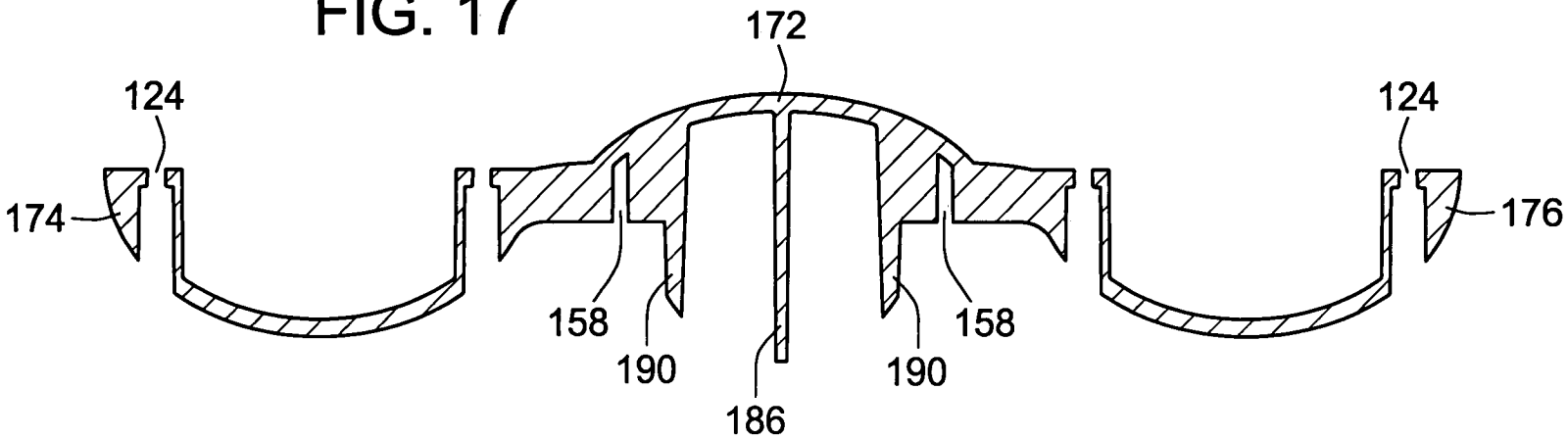
FIG. 17 is a section view illustration taken about line 17—17 illustrated in FIG. 15.
Figure 18:
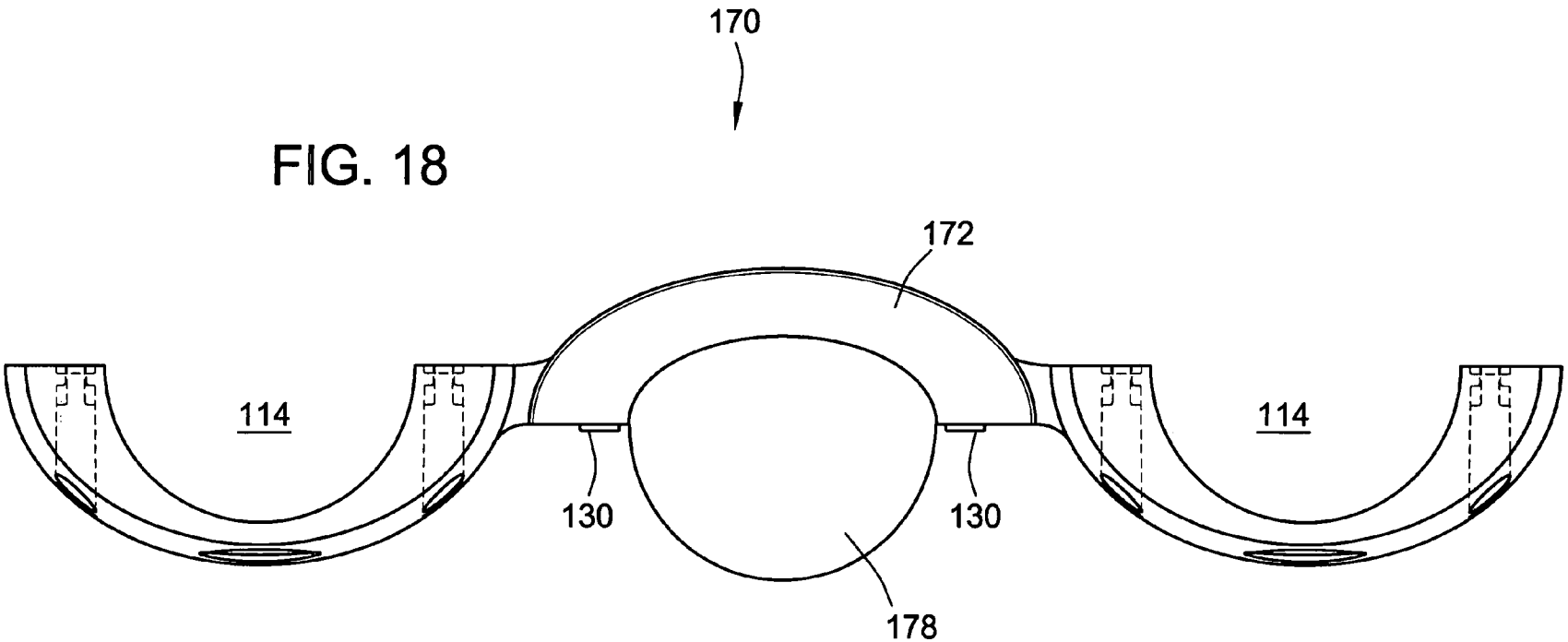
FIG. 18 is an end view illustration of the dual mounting bracket of FIG. 13.

The orientation of the lateral support carriages 174, 176 in relation to the central mounting yoke 172 may be better seen from the top view illustration of FIG. 15. This FIG. 15 also includes two cross section lines to illustrate the varying cross section of the dual mounting bracket 170 at different locations in a preferred embodiment. These two cross sections are illustrated in FIGS. 16 and 17. As may be seen from these cross sectional illustrations, the composite structure of a preferred embodiment of the present invention minimizes weight and maximizes rigidity and structural integrity. The end view illustration of FIG. 18 illustrates the configuration of the longitudinal mounting trough 114 and the closure structure 178.

Figure 19:
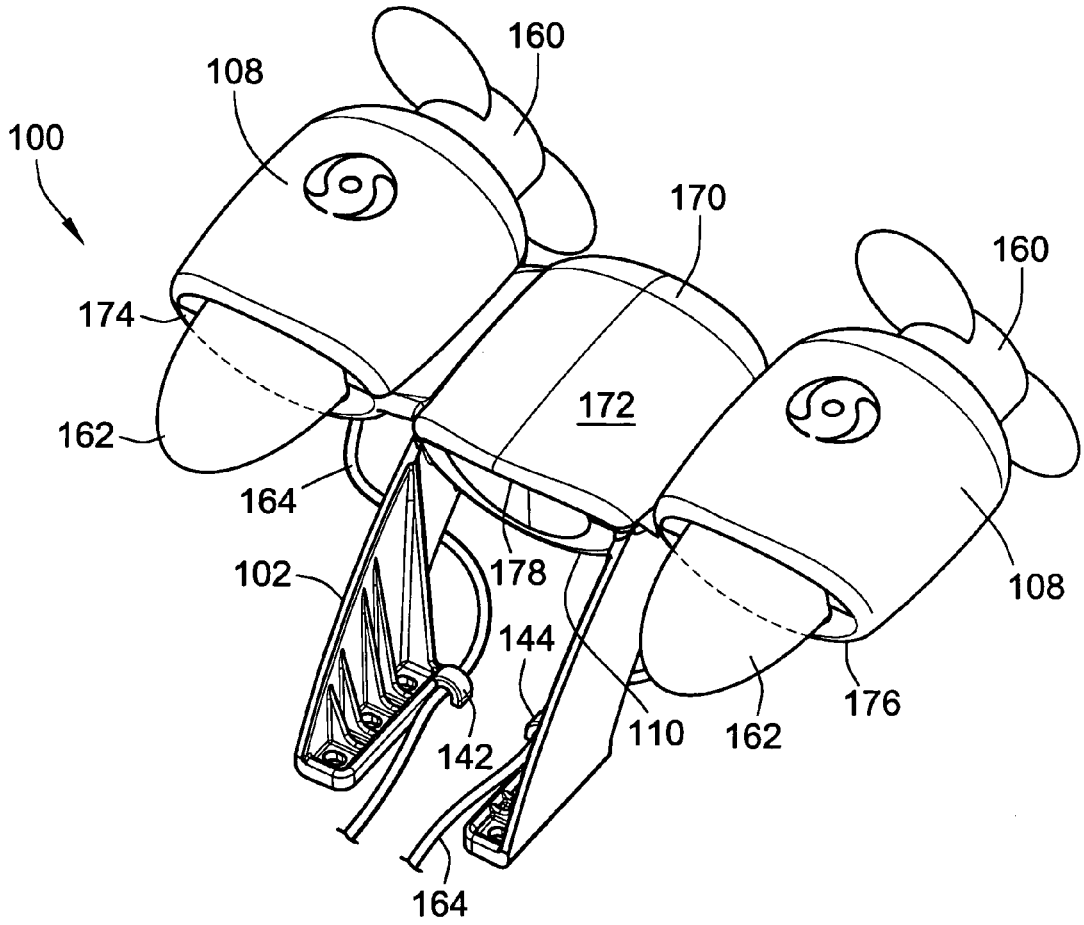
FIG. 19 is an isometric illustration of one embodiment of an assembled modular mounting bracket accommodating dual trolling motors.

FIG. 19 illustrates a complete assemblage of the modular bracket 100 of the present invention including dual trolling motors/lower units 160. The cables 164 for each of the trolling motors/lower units 160 are held in place by the cable guide claws 142, 144. In this configuration, the angler will be able to realize twice the thrust of the single trolling motor/lower unit configuration. Such increased thrust is very helpful to control the vessel during periods of heavy loading or adverse conditions and for larger vessels.

Figure 20:
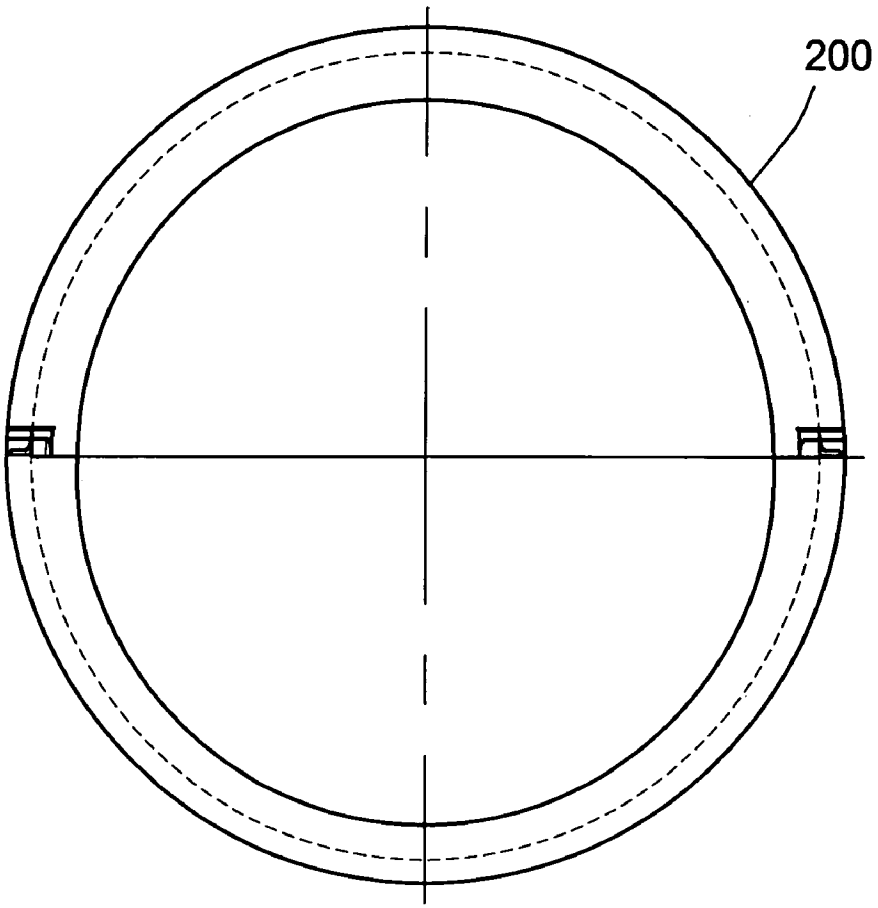
FIG. 20 is an end view illustration of one embodiment of a front adaptor ring that may be used to accommodate a different sized trolling motor.
Figure 21:
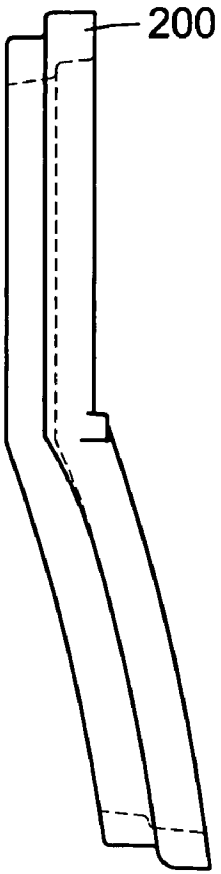
FIG. 21 is a side view illustration of the front adaptor ring of FIG. 20.
Figure 22:
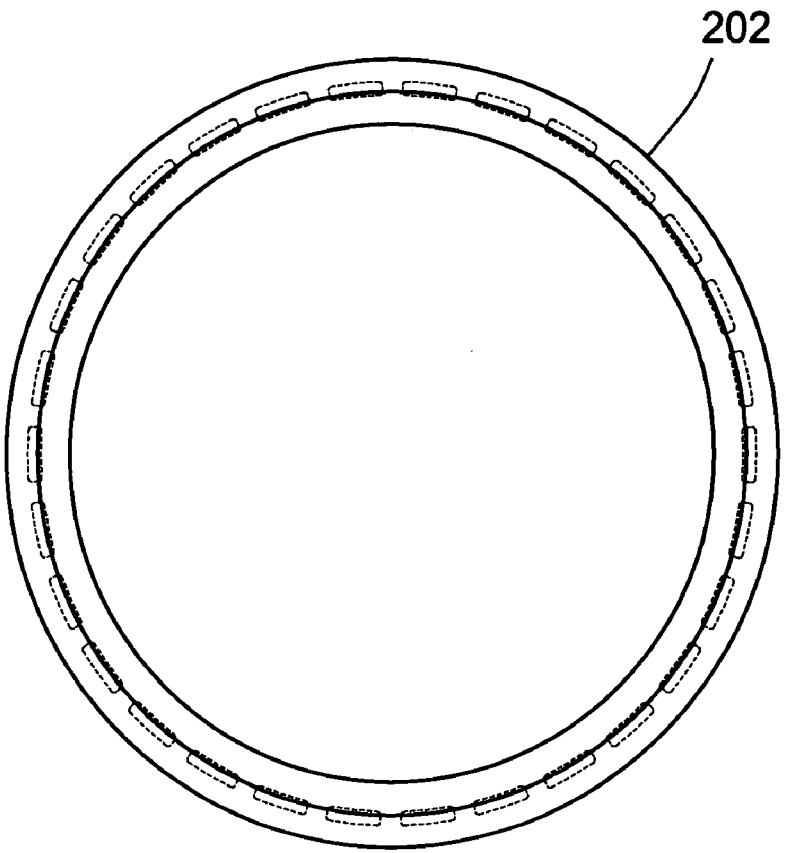
FIG. 22 is a end view illustration of one embodiment of a rear adaptor ring that may be utilized to accommodate a different sized trolling motor.
Figure 23:
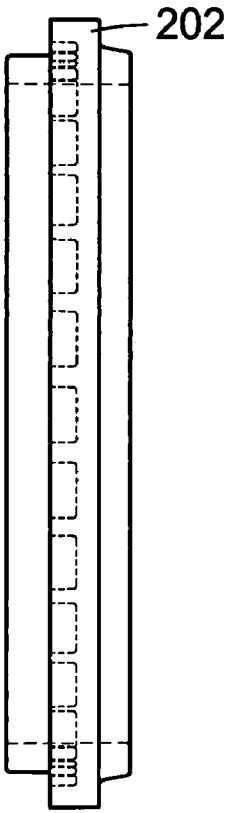
FIG. 23 is a side view illustration of the rear adaptor ring of FIG. 22.

To provide even more flexibility in selecting different sized trolling motors/lower units, without requiring the angler to purchase different brackets, a preferred embodiment of the present invention includes adaptor rings that may be used to secure smaller trolling motors in the bracket of the present invention. These adaptor rings can be of varying sizes so as to provide a wide range of compatibility with trolling motors/lower units of different sizes. FIGS. 20 and 21 illustrate one embodiment of a front adaptor ring 200. The geometry of the mounting ring, as best illustrated in FIG. 21, is such to mate with the support carriage and the EM top cap. FIGS. 22 and 23 illustrate an embodiment of a rear adaptor ring 202. These adaptor rings are sized to fit around the outer periphery of the trolling motor/lower unit and have a ring wall height to cover the difference in diameter of the trolling motor passage formed when the EM top cap and the support carriage are mated together. With such adaptor rings, the modular EM mounting bracket of the present invention may be used with a wide variety of trolling motors/lower units to provide an angler with a vast array of thrust options in each engine mount configuration.

Figure 24:
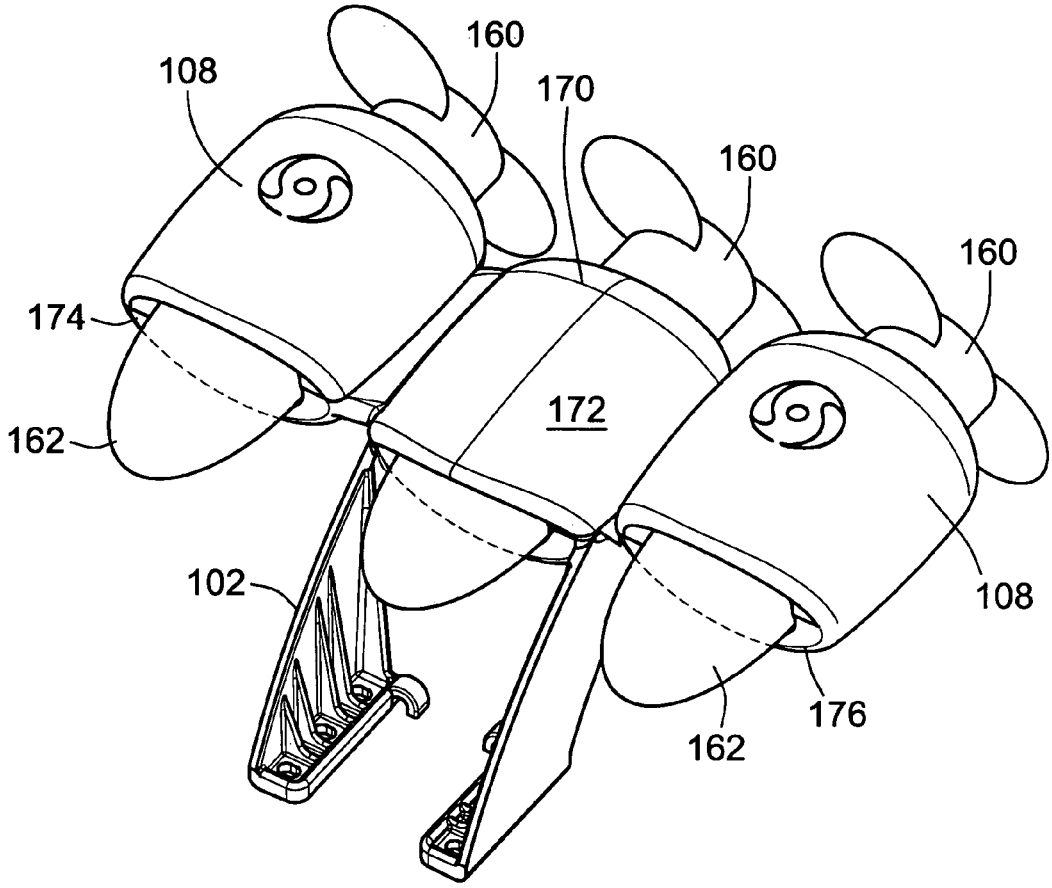
FIG. 24 is an isometric illustration of one embodiment of an assembled modular mounting bracket accommodating three trolling motors.
Figure 25:
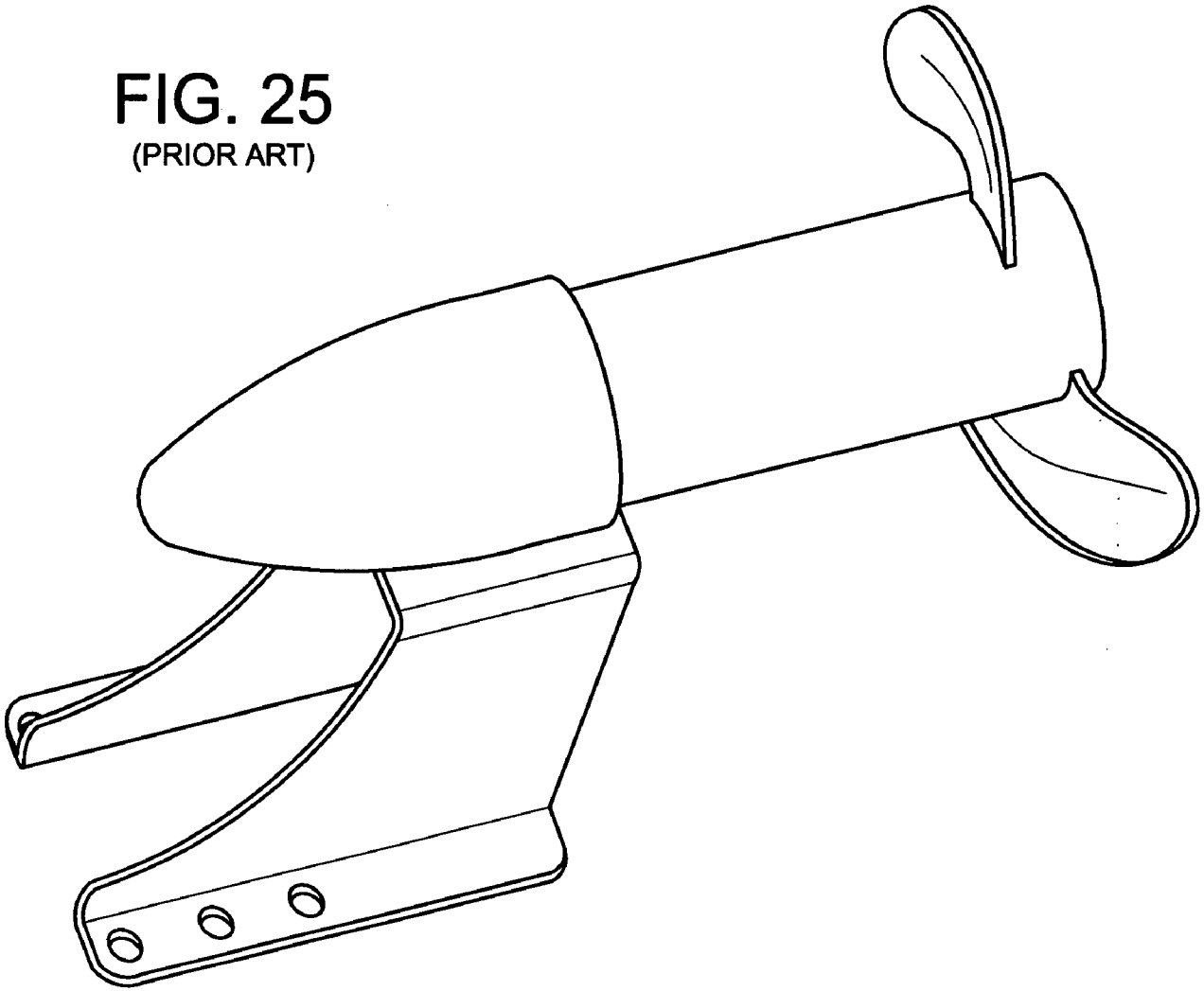
FIG. 25 (PRIOR ART)
FIG. 25 is a isometric illustration of a prior engine mounted trolling motor utilizing a stamped metal bracket for mounting to the cavitation plate of the main outboard or inboard/outboard engine of a vessel.

FIG. 24 illustrates yet a further embodiment of the modular bracket 100 of the present invention configured to accommodate three trolling motors/lower units. In this alternate embodiment, the central mounting yoke 172 does not include the trough closure structure of the previous embodiment, but instead is configured internally similar to the EM top cap 108. In this way, three trolling motors may be accommodated to provide three times the amount of thrust available in the single trolling motor configuration.

All references, including publications, patent applications, and patents cited herein are hereby incorporated by reference to the same extent as if each reference were individually and specifically indicated to be incorporated by reference and were set forth in its entirely herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A modular bracket system for engine mounted trolling motors, comprising:

a lower mounting engine mount (EM) bracket having a pair of mounting legs positioned on either side of a central support carriage, the mounting legs terminating at a lower portion thereof in a mounting land, each mounting land having provided therethrough a first plurality of mounting holes for receiving fasteners therein, the central support carriage defining a mounting trough configured to receive a trolling motor/lower unit therein, the central support carriage defining a second plurality of mounting holes therethrough; and at least one EM top cap configured to mate with the central support carriage to secure the trolling motor/lower unit therebetween, the EM top cap including a third plurality of mounting bores therein positioned to align with the second plurality of mounting holes in the central support carriage.

2. The modular bracket system of claim 1, further comprising:

a dual mounting bracket having a central mounting yoke configured to be received by the central support carriage of the lower mounting EM bracket, the central mounting yoke including a fourth plurality of mounting bores therein positioned to align with the second plurality of mounting holes in the central support carriage, the dual mounting bracket further having a pair of lateral support carriages positioned on either side of the central mounting yoke, each lateral support carriage defining a lateral support carriage mounting trough configured to receive a trolling motor/lower unit therein and to mate with one of the at least one EM top cap, each lateral support carriage defining a fifth plurality of mounting holes therethrough positioned to align with the third plurality of mounting bores in the EM top cap; and wherein one of the at least one EM top cap mates with each of the lateral support carriages to secure a trolling motor/lower unit therebetween.

3. The modular bracket system of claim 2, wherein each of the EM top caps and the lateral support carriages are configured to secure a trolling motor/lower unit of a first size therebetween, the modular bracket system further comprising a front and a rear adapter ring configured to be held between the EM top cap and each of the lateral support carriages to allow a trolling motor/lower unit of a second size smaller than the first size to be secured therebetween.

4. The modular bracket system of claim 2, wherein the central mounting yoke configured to mate with the central support carriage to secure a third trolling motor/lower unit therebetween.

5. The modular bracket system of claim 2, wherein the central mounting yoke includes a support carriage trough closure structure configured to mate with the mounting trough of the central mounting yoke.

6. The modular bracket system of claim 2, wherein the dual mounting bracket is formed from composite material.

7. The modular bracket system of claim 2, wherein each of the lateral support carriages includes at least one knock out formed in the lateral support carriage mounting trough, the at least one knock out positioned to accommodate a bung of the trolling motor/lower unit to be secured thereon.

8. The modular bracket system of claim 2, wherein the EM top cap and each of the pair of lateral support carriages are keyed to allow the EM top cap to mount on each of the lateral support carriages in only one orientation.

9. The modular bracket system of claim 1, wherein the EM top cap and the central support carriage are configured to secure a trolling motor/lower unit of a first size therebetween, the modular bracket system further comprising a front and a rear adapter ring configured to be received by the EM top cap and the central support carriage to allow a trolling motor/lower unit of a second size smaller than the first size to be secured therebetween.

10. The modular bracket system of claim 1, wherein the central support carriage includes at least one knock out formed in the mounting trough, the at least one knock out positioned to accommodate a bung of the trolling motor/lower unit to be secured thereon.

11. The modular bracket system of claim 1, wherein at least one of the mounting lands includes a cable guide claw adapted to guide a trolling motor control cable therethrough.

12. The modular bracket system of claim 11, wherein each of the mounting legs includes a plurality of support ribs extending from the mounting land.

13. The modular bracket system of claim 1, wherein the lower mounting EM bracket and the EM top cap are formed from composite material.

14. The modular bracket system of claim 1, wherein the EM top cap and the central support carriage are keyed to allow the EM top cap to mount on the central support carriage in only one orientation.

15. A modular engine mount (EM) trolling motor mounting bracket, comprising:

a composite lower mounting EM bracket having a central support carriage defining a longitudinal mounting trough, the lower mounting EM bracket further having a pair of forwardly downwardly depending mounting legs formed on either side of the central support carriage terminating in a pair of mounting lands;

a composite EM top cap defining a longitudinal top cap mounting trough; and wherein the mounting trough of the lower mounting EM bracket and the top cap mounting trough define a trolling motor passage therethrough when the EM top cap is mounted on the lower mounting EM bracket.

16. The modular EM trolling motor mounting bracket of claim 15, further comprising a front and a rear adapter ring configured to be received in the trolling motor passage to reduce a diameter of the trolling motor passage to accommodate a trolling motor of a small size therethrough.

17. The modular EM trolling motor mounting bracket of claim 15, further comprising a composite dual mounting bracket having a central mounting yoke, the central mounting yoke includes a support carriage trough closure structure configured to mate with and close the mounting trough of the central mounting yoke, the dual mounting bracket further including a pair of lateral support carriages positioned on either side of the central mounting yoke, each lateral support carriage defining a lateral support carriage mounting trough; and wherein the lateral support carriage mounting troughs and the top cap mounting trough define a pair of trolling motor passages therethrough when the EM top cap is mounted on each of the lateral support carriages.

18. The modular EM trolling motor mounting bracket of claim 17, further comprising a pair of front and a pair of rear adapter rings configured to be received in the pair of trolling motor passages to reduce a diameter of the pair of trolling motor passages to accommodate trolling motors of a small size therethrough.

19. The modular EM trolling motor mounting bracket of claim 17, wherein the EM top cap and each of the pair of lateral support carriages are keyed to allow the EM top cap to mount on each of the lateral support carriages in only one orientation.

20. The modular EM trolling motor mounting bracket of claim 15, wherein the EM top cap and the central support carriage are keyed to allow the EM top cap to mount on the central support carriage in only one orientation.

21. A modular engine mount (EM) trolling motor/lower unit mounting bracket, comprising:

a lower mounting EM bracket having a central support carriage defining a longitudinal mounting trough for receiving a trolling motor/lower unit;

a dual mounting bracket having a central mounting yoke, the central mounting yoke including a support carriage trough closure structure configured to mate with and close the mounting trough of the central mounting yoke, the dual mounting bracket further including a pair of lateral support carriages positioned on either side of the central mounting yoke, each lateral support carriage defining a lateral support carriage mounting trough for receiving a trolling motor/lower unit;

at least one EM top cap defining a longitudinal top cap mounting trough; and wherein the EM top cap is secured on the central support carriage to enable engine mounting of one trolling motor/lower unit; and wherein the central mounting yoke is secured on the central support carriage and one of the at least one EM top caps is secured on each of the lateral support carriages to enable engine mounting of two trolling motors/lower units.

* * * * *